United States Patent [19]

Bialek

[11] 4,014,489

[45] Mar. 29, 1977

[54] VARIABLE YARN FEED DEVICE

[75] Inventor: Stephen M. Bialek, Barrington, R.I.

[73] Assignee: Providence Pile Fabric Corporation, Fall River, Mass.

[22] Filed: Dec. 1, 1975

[21] Appl. No.: 636,552

[52] U.S. Cl. ..... 226/9; 226/4; 226/111; 226/178; 226/190

[51] Int. Cl.[2] ..... B65H 17/20; B65H 17/52

[58] Field of Search ..... 226/4, 9, 42, 43, 108, 226/109, 111, 178, 190; 28/1.4; 57/34 B

[56] References Cited

UNITED STATES PATENTS

| | | | |
|---|---|---|---|
| 2,880,684 | 4/1959 | Masland | 226/108 X |
| 2,954,865 | 10/1960 | Hackney et al. | 226/9 |
| 3,026,011 | 3/1962 | Grass | 226/178 |
| 3,805,344 | 4/1974 | Bartnicki et al. | 226/108 X |

*Primary Examiner*—Robert W. Saifer
*Attorney, Agent, or Firm*—Salter & Michaelson

[57] ABSTRACT

A device for feeding strands such as for further textile processing wherein driving means comprising a pair of nip rolls are continuously and drivingly engaged with the strand extending therebetween, said nip rolls being movably supported between spaced speed-control rolls which are operable at different surface speeds so that selective movement of said nip rolls as a unit against the surface of one or the other of the speed-control rolls serves to drive the nip rolls and thus in turn feed the strand located therebetween at different rates. This device has particular utility in producing air-textured composite yarns, including both core-and-effect and slub-type yarns, but is not limited to such use.

18 Claims, 9 Drawing Figures

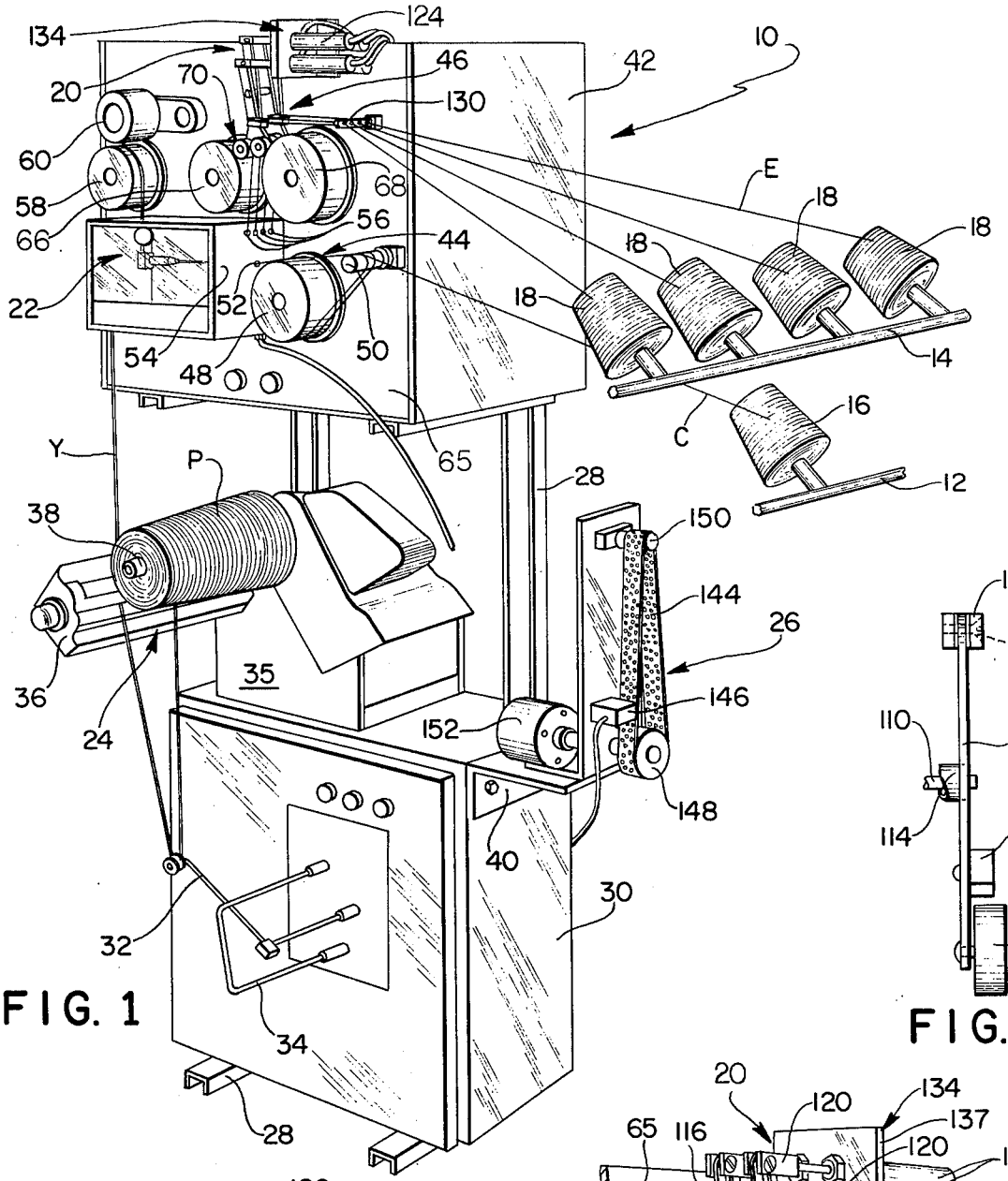
FIG. 1
FIG. 4
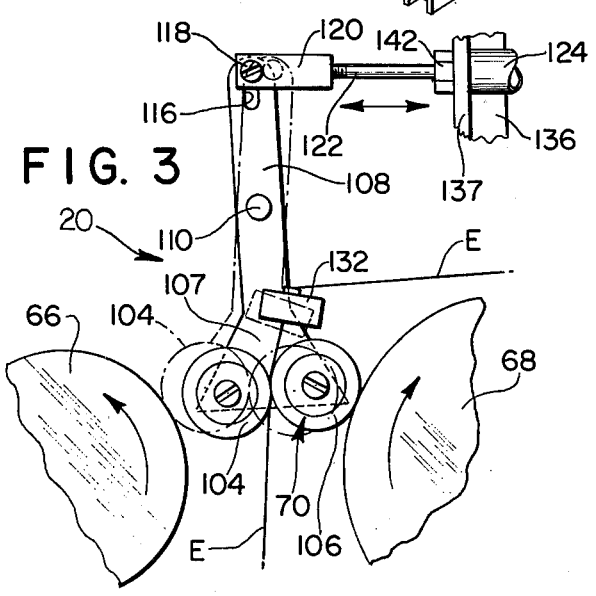
FIG. 3
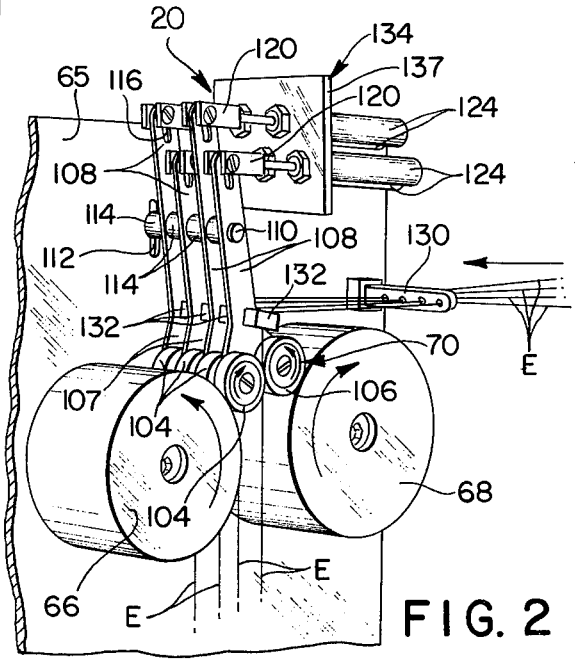
FIG. 2

VARIABLE YARN FEED DEVICE

BACKGROUND OF THE INVENTION

It is required in many textile and nontextile applications to be able to feed a strand from one point to the other at preselected varying rates of speed. One common use for such technique is in the application for the formation of air-textured core-and-effect yarns wherein a plurality of yarn strands are fed to an air texturing jet so as to entangle them into a composite yarn mass in particular manners dependent on the end product desired. In such technique, it is generally necessary to overfeed to varying extents one or more of the individual strands passing to the air texturing unit so as to emphasize either by color, texture or other physical property such yarn or yarns in the final assembly, i.e., a particular color yarn could be overfed at periodic internals so that a greater proportion of such yarn color would predominate at such periodic intervals within the resultant yarn formed thereby. Similarly, multilevel slubs may be formed by application of similar techniques.

Mechanisms are heretofore known which periodically feed strand at such varying rates, such as, for example, the device disclosed in U.S. Pat. No. 3,805,344, which has particular utility in the specific air texturing processes above mentioned. This device includes first and second yarn feed rolls operating at different surface speeds. Each feed roll has an idler roll associated with it but spaced therefrom. Also included are means for alternatively moving one of the idler rollers against the feed roll with which it is associated so as to force yarn passing thereover against such feed roll to drive the yarn. This device, although being commercially used, does not maintain continuous control over the yarn as it is fed, inasmuch as each time the yarn is transferred from contact with one feed roll to contact with the other feed roll, the yarn is momentarily free to run out of the intended yarn path. The provision of control means to prevent such runout and to otherwise provide a more positive control requires the incorporation of highly critical alignment mechanism. Devices of this type are also not adapted for the simultaneous feed of a plurality of yarns at different rates.

It accordingly is desirable to provide strand feeding mechanism which enables one or more separate strands to be alternatively fed at varying rates of speed, as for further processing to downstream work stations, such as the air texturing process above referred to, and to accomplish such while maintaining a high degree of control over each such strand.

SUMMARY OF THE INVENTION

The present invention accomplishes these aims while avoiding the aforesaid prior-art shortcomings by the provision of a strand feeding device comprising a rotatable drive means in the form of a pair of nip rolls which continuously frictionally engage each strand, a first speed control roll rotatable at a relatively slow surface speed and a second speed control roll spaced therefrom and rotatable at a second and a relatively high surface speed, means for supporting the drive means between such first and second speed control rolls and means for alternatively moving the drive means as a unit against either said first or second roll so as to rotate said drive means at varying rates of speed so as to accordingly vary the rate at which the yarn is fed. The device further embodies structure enabling a plurality of such strands to be simultaneously driven at varying rates of speed while utilizing only one set of spaced speed control rolls, the assembly being constructed in such a manner that the several sets of nip rolls may be quickly and easily disassembled whenever necessary or desirable.

It is therefore a primary object of the present invention to provide a device for feeding strand at varying rates wherein the strand is continuously frictionally engaged by rotatable drive means.

Another object of the invention is the provision of a feeding device for strand wherein a plurality of separate strands may be fed at varying rates and wherein each strand is continuously frictionally engaged by separate portions of a composite drive means.

A still further object of the invention is the provision of a device wherein a drive means continuously engages a strand while feeding same at different rates of speed by being alternatively forced against one or the other of a pair of spaced rotating speed control rolls rotating at different surface speeds and wherein a plurality of such strands may be fed by the simultaneous contact of a plurality of spaced drive nip rolls with a single pair of speed-control rolls so that the necessity of utilizing separate pairs of speed-control rolls for each strand is obviated.

Still another object of the present invention is the provision of a device for feeding a plurality of individual strands at varying rates by selective contact of individual drive means with one or the other of spaced speed-control rolls rotating at different speeds and wherein such drive means may be easily disassembled whenever necessary or desirable.

Other objects, features and advantages of the invention will become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 1 is a perspective view of an overall machine assembly embodying the present invention;

FIG. 2 is an enlarged fragmentary perspective view showing in particular the feed portion thereof;

FIG. 3 is a front elevational view of the feeding device shown in FIG. 2;

FIG. 4 is a partial side elevation of the feed device shown in FIG. 2;

DESCRIPTION OF THE INVENTION

Figure 5:
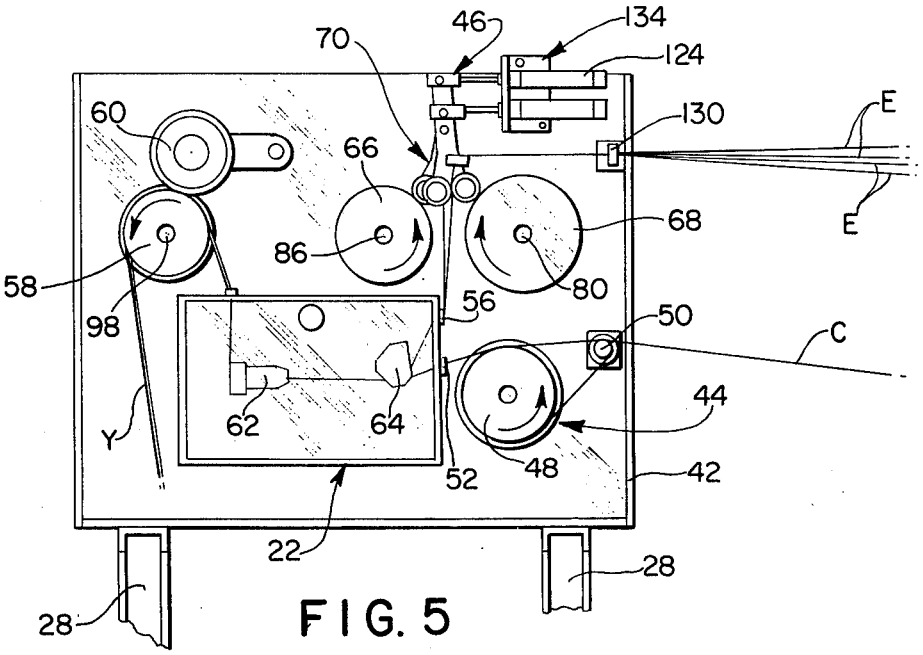
FIG. 5 is a front elevation view of a portion of FIG. 1 and showing in particular the feeding relationship of separate core-and-effect yarns in a specific air texturing textile process.

Although the feeding device of the present invention is disclosed within the environment of an overall air texturing textile process and has particular utility therein, such device, as well as the term "strand" as used herein, is employed in a general sense to include all kinds of strand, either textile or otherwise; and, accordingly, it should be clear that such broader concept of the invention is contemplated.

In the drawings, and in particular FIG. 1 thereof, an overall machine assembly 10 capable of taking different individual yarn strands and producing a composite yarn therefrom, and capable of achieving various design and novelty effects by air texturing, is shown. Apparatus for taking up and winding such yarn into usable packaged forms is also depicted. The assembly 10 includes creel mechanisms 12 and 14 on which a core yarn supply package 16 and a plurality of effect yarn supply packages 18 are mounted in a conventional manner so as to supply feed station 20. The feed station in turn serves to feed the various effect yarn strands at varying speeds to an air texturing station 22 and finally to a take-up station 24 wherein the resultant air-textured composite fiber is wound into a cone or alternate finished package P for use in further processing, such as weaving or knitting.

The overall assembly 10 is mounted on suitable supports 28 and includes a lower enclosure 30 which may house various service components of the overall assembly, such as the tension compensator 32 and the take-up speed-regulation means shown at 34. The enclosure 30 additionally serves as a base for the take-up means 24 proper, that is, the machine base 35, including its drive means (not shown), which in turn supports the traverse means 36 and the support means 38 for package P. The package support may be driven directly or indirectly, and the take-up means 24 may be of any appropriate design, it being clear that its function is to receive the yarn from the upstream processing station whether such be the air texturing station 22 depicted or that of some other process, either textile or nontextile, and wind such into a usable package P. The take-up station 24 and the processing station 22 in and of themselves form no part of the present invention. The lower enclosure 30 also comprises a support, such as bracket 40, for mounting the speed-selection or programming station 26 of the overall assembly 10.

The assembly frame or support 28 further serves to support an upper enclosure 42 in which the feed and processing stations 20 and 22, respectively, are appropriately mounted. The enclosure 42 further serves to support the various drive means appurtenant to the feed and processing stations 20 and 22, as will be more clearly brought out hereinafter.

The feed station 20 includes a sub-assembly 44 for feeding the core yarn C from its supply package 16 and a subassembly 46 for feeding the individual strands of the effect yarns E from their respective supply packages 18. The core yarn feed sub-assembly 44 includes a drive roll 48 and a separator roll 50 which enables multiple wraps to be taken around the drive roll 48 so as to better produce consistent core yarn speeds. The core yarn C is fed to the texturing station 22 through an opening 52 provided in housing 54 and at a constant feed, as is conventional in such processes.

The effect yarn feed sub-assembly 46, on the other hand, enables any one or multiple number of such effect yarns to be fed to the air texturing station 22 via openings 56 in the enclosure 54 at varying rates, dependent entirely upon the particular effects desired in the resultant yarn, and this sub-assembly forms one of the more-important parts of the present invention. The resultant composite yarn Y passes through nip rolls 58 and 60 which serve to maintain tension control on the finished yarn as it leaves the air texturing station 22. The texturing station 22 includes an air texturing jet 62 of known construction, such as, for example, that disclosed in U.S. Pat. No. 3,577,614. A consolidation guide and wetting device 64 (FIG. 5) for preliminarily joining the multiple strands of effect and core yarn and for wetting same prior to their formation into a composite finished yarn by the air texturing unit is also included.

The front surface of the enclosure 54 may be transparent, as depicted, so that entanglements or undesired variations in the finished yarn products may be immediately observable by an assembly operator.

The feed sub-assembly 46, which enables individual effect strands to be fed at varying speeds while always positively gripped in a frictional engagement with drive means therefor, is best illustrated in FIGS. 2–4 of the drawings, to which specific reference will now be made. Mounted on front wall 65 of the enclosure 42 are two speed-control rolls 66 and 68 adapted for rotation in opposite directions at different surface speeds. Such surface speed differential may be accomplished by driving the rolls at different speeds or having one such roll of a smaller diameter that the other, or a combination thereof. In the specific embodiment shown, the roll 66 is both driven at a lower speed and is of a smaller diameter than roll 68. Accordingly, roll 66 is adapted for rotation at a first relatively slow surface speed, and roll 68 is adapted for rotation at a second and relatively fast surface speed. The particular disposition or spacing of such rolls 66 and 68 is not critical so long as they are operative to supply different speeds to drive means 70, provided for each effect yarn strand E, as will hereinafter be more apparent.

Figure 6:
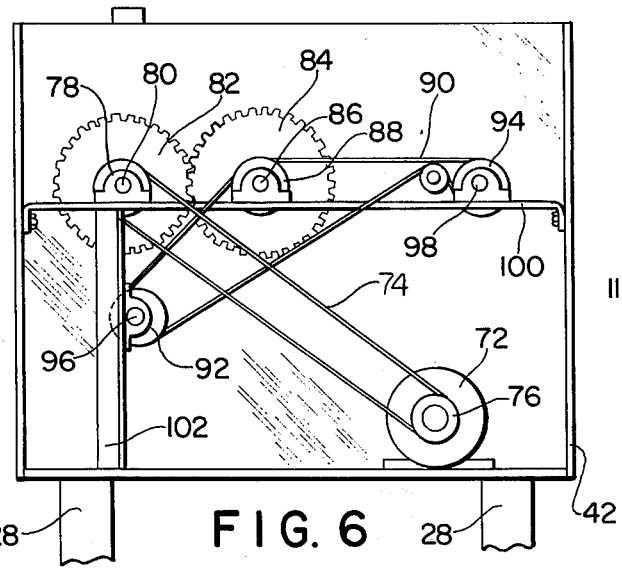
FIG. 6 is a rear elevational view of the feed and texturing stations shown in FIG. 5 and showing the drive means for the various components thereof.

As best shown in FIG. 6 of the drawings, a motor 72 is mounted on the bottom of enclosure 42. A belt 74 extends over pulleys 76 and 78 and serve to rotate drive shaft 80 of the high-speed roll 68 while at the same time rotating a gear 82 affixed thereto. Gear 82 is adapted to mesh with gear 84, which is of a slightly larger diameter than gear 82 and includes a greater number of cogs or teeth around the periphery thereof. This relationship results in driven gear 84 rotating at a slower speed than gear 82 and, accordingly, serves to impart such slower speed to shaft 86, in turn connected to roll 66, so as to drive such roll at a relatively low surface speed. Shaft 86 may in turn be provided with a pulley 88 over which a second belt 90 extends. The belt 90 engages pulleys 92 and 94 connected respectively to shafts 96 and 98 and which serve to rotate rolls 48 and 58, respectively. The belts, shafts and pulleys are conventionally supported from bracket 100 and post 102 in suitable trunions and/or bearing blocks.

Each drive means 70 includes a pair of nip rolls 104 and 106 having a high frictional surface, such as a covering of polyurethane, rubber, etc. The nip rolls 104, 106 are rotatably mounted in driving relation with each other on the bifurcated end 107 of a lever 108. A plurality of such levers 108, which in turn support a plurality of nip roll sets, are adapted for side-by-side mounting between the speed-control rolls 66 and 68 by means of a fulcrum pin 110 which is secured within slot 112 formed in the wall 65 of enclosure 42 and adapted for vertical adjustment therein so that the plurality of drive means 70 may be properly positioned for varying size rolls 66 and 68, and may be properly spaced therebetween so as to enable individual nip roll sets 104, 106 to be alternatively moved into actuation contact with one or the other of the speed-control rolls. While it has been indicated that the drive means 70 and the speed-control members 66, 68 are rolls, it should be pointed out that although rolls are preferred, other constructional means which permit strand nipping and rotational force translating, such as endless belts, could be utilized.

Cylindrical spacers 114, which are supported by the fulcrum pin 110, serve to properly space the individual levers 108 apart from each other. The upper end of each lever 108 is provided with a vertically orientated slot 116 open at the top thereof and adapted for receipt of a clevis pin 118 supported between opposed sides of a clevis 120 which is in turn connected to the shaft 122 of a cylinder 124. Each of the shafts 122 are in turn adapted for reciprocal movement, as best shown by the arrows in FIG. 3 of the drawings. Such action causes the levers 108 to rock on pin 110, thus transmitting lateral motion to the lower portions of the individual levers 108 and accordingly to the drive means 70. The movement of the levers 108 accordingly serves to alternatively force one or the other of the nip rolls 104 or 106 of the individual drive means 70 against that speed-control roll to which such nip roll is adjacently positioned. Since each individual drive means 70 and its attendant lever is provided with a separate actuation cylinder 124, the lateral motion of the shafts 122, provided by any known cylinder and piston mechanism, independently drives the individual yarn strands passing through the feed station 20 at either a relatively high speed or at a relatively low speed, dependent on which speed-control roll an individual drive means 70 is in contact with at that time. As will be seen most clearly in FIG. 2, a total of four drive means 70 are provided, which means that four effect yarns are being fed, although obviously more or less could be utilized, if more or less drive means 70 are provided. In order to provide more space for the shafts 122, the upper ends of levers 108 are alternately staggered, as shown in FIG. 2.

It should be clear that the frictional contact between either of the speed-control rolls 66, 68 with either of the nip rolls 104 or 106 imparts rotation to the appropriate drive means 70 in which the individual strand is caught in the nip thereof and continuously frictionally engaged thereby. Such frictional contact serves to feed such individual strand at alternate rates of speed, dependent on which speed-control roll is rotating its drive means at the moment. Individual strands of yarn E are guided to the feed station 20 via a plural guide 130 and then through individual guides 132 mounted on each lever 108 above and generally intermediate the rolls 104 and 106 so as to better assure direct movement of such strands into the nip of such drive rolls.

Figure 8:
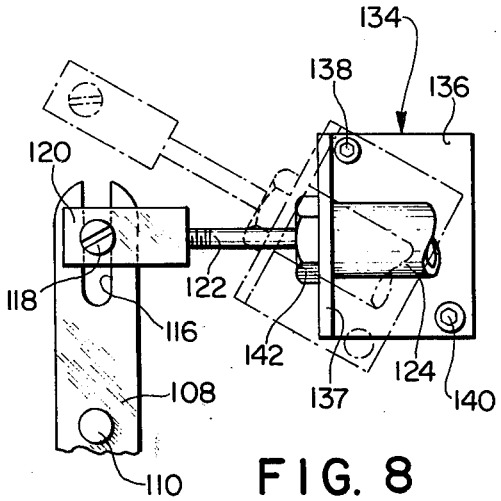
FIG. 8 is an enlarged front elevational view showing the particular manner in which the drive means of the feed device may be readily disassembled from the actuation means thereof for quick replacement.

To facilitate the removal of sub-assembly 46, as upon the formation of undesirable yarn wraps around one or more of the nip rolls 104, 106, quick-release mounting means 134, as is best shown in FIG. 8 of the drawings, is provided. Such mounting means 134 includes a bracket 136 having a flange 137 outwardly extending therefrom. The bracket 136 is connected at two spaced points thereon to wall 65 of enclosure 42 by attachment means, such as bolts 138 and 140. Bolt 140 may be of a quick-release slotted-pin type, which, upon removal, permits bracket 136 to pivot clockwise about bolt 138, as depicted by the dotted-line representation thereof in FIG. 8. The pivoting of bracket 136 serves to disengage the individual clevises and clevis pins 120 and 118, respectively, from the lever slots 116 so as to free the levers 108 from their actuating means. The cylinders 124 are positioned and supported in the bracket 136 solely by their end engagement with openings formed in the flange 137 of the bracket 136, and affixed thereto by means of nuts 142. The clevis pins 118 are afforded sufficient clearance within slots 116 to avoid binding therein during upward removal therefrom. It will thus be apparent that by removing the bolt 140, the bracket 136 is free to pivot clockwise about bolt 138 and accordingly enables the simultaneous removal of all the clevis pins 118 and clevises 120 from the ends of levers 108, so that the levers and nip roll drive means supported thereby may thereafter be easily removed as a unit from their mounting in slot 112. A duplicate or similar feed sub-assembly 46 may then be substituted, or, alternatively, the assembly can be cleared of wraps or similar occurrences, rethreaded, and repositioned into operative position.

Figure 9:
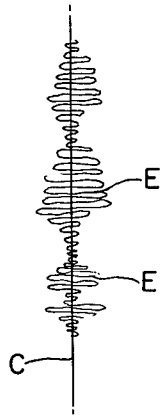
FIG. 9 is a stylized schematic view of a composite core-and-effect yarn produced from the overall machine assembly shown.
Figure 7:
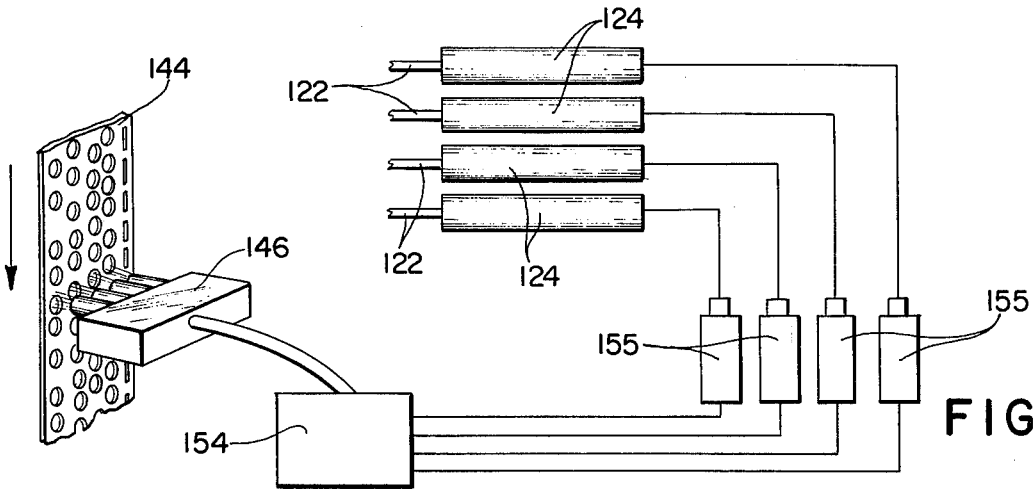
FIG. 7 is a schematic representation of a program device for selecting the speed at which various strands are fed.

The manner in which the speed of the individual strands are controlled by control station 26 is best depicted by simultaneous reference to FIGS. 1 and 7 of the drawings. Therein an opaque tape 144 is supported for movement between a light source (not shown) and a photoelectric cell 146. The tape 144 may be in the form of a continuous band and supported for rotation about drive and idler rolls 148 and 150, respectively, and powered by means of motor 152 mounted on bracket 40. The tape is further provided with a series of openings across the lateral extent thereof corresponding with the number of individual drive means to be controlled. The photoelectric means 146 is thus able to sense the presence or absence of light and accordingly transmit that signal into an electrical impulse at relay 154 so as to operate solenoid-activated air valves 155 which in turn serve to control air cylinders 124. The air cylinders 124 operate piston shafts 122 thereof and in this manner control the position of the individual levers 108, and accordingly the speed at which the drive means associated with each lever serves to feed the individual yarn frictionally engaged thereby. Thus, as the tape 144 is continuously fed, different series of openings continuously move into alignment with cell 146, and, depending on what openings are so aligned, the corresponding valves 155 and cylinders 124 are actuated to change the position of the corresponding drive means 70 and hence the rate of feed of the effect yarn driven thereby, all as previously described. It will thus be seen that it is possible to continuously change the rate of feed of each effect yarn, whereby if the yarns are of different colors, it is possible to have one or more colors predomimate at selected intervals along the composite yarn by overfeeding those colors at said intervals, i.e., by having the drive means for those colors moved into engagement with the high-speed control roll 68 at said intervals. By the same token, separate and apart from color variations, multilevel slubs, as illustrated in FIG. 9, can be formed by overfeeding one or more effect yarns in varying combinations. Obviously, multilevel slubs having varying color characteristics can also be formed, and by programming the tape 144, it is possible to precontrol exactly what novelty yarn is to be formed, or, if preferred, the pattern can be completely random, repeating only when the tape 144 has completed its travel. This capability of providing a yarn that does not necessarily have a short repetitive cycle is highly advantageous. Also, it is possible to use the variable feed of the present invention wherein different types of effect yarn are variably fed, i.e., using acid, cationic, deep-dye and black nylons or using mixtures of acetate, rayon and dye-resist yarns, for example. The present invention may also be used in a system where no core yarn is employed, but rather the composite yarn is achieved solely by the variable feed of the plurality of effect yarns.

Although one programming station 26 is shown for the single unit 10, it will be understood that the station 26 could be utilized to simultaneously program a plurality of units 18.

It should thus be apparent that an overall assembly is depicted which specifically provides a practical means for forming various core-and-effect yarns, such as by air texturing, which assembly comprises a novel and unique feed device which enables individual strands, regardless of the type of operating station to which they are being fed, to be continuously frictionally engaged between individual nip rolls, thus assuring better strand control than in prior art devices. The speed at which one or more of a plurality of strands is fed can be selectively changed while utilizing only one pair of speed-control rolls. Furthermore, the manner in which the feed device can be easily disassembled, removed and/or repositioned greatly enhances the commercial value of the apparatus.

While there is shown and described herein certain specific structure embodying the invention, it will be manifest to those skilled in the art that various modifications of the parts may be made without departing from the spirit and scope of the underlying inventive concept and that the same is not limited to the particular forms herein shown and described except insofar as indicated by the scope of the appended claims.

What is claimed is:

1. A device for feeding strand at varying rates comprising, rotatable drive means for continuously gripping said strand, a first speed-control member rotatable at a first relatively slow surface speed in one direction, a second speed-control member spaced from said first member and rotatable art a second relatively fast surface speed in the opposite direction, means for supporting said drivê means between said first and second members with said gripped strand always being maintained out of contact with said members, and means for selectively moving said drive means into operative association with said first or said second member so as to alternatively rotate said drive means at said first or said second speed, and accordingly vary the rate at which said strand is fed.

2. The device of claim 1, said drive means comprising a pair of nip rolls having high frictional surfaces for continuously engaging said strand therebetween.

3. The device of claim 2, said first and said second speed control members being a pair of rolls.

4. The device of claim 3, said supporting means comprising a lever supported for pivotal movement about an intermediate fulcrum, said nip rolls being rotatably mounted adjacent one end of said lever, said selectively moving means comprising a reciprocal rod engaging the other end of said lever, whereby reciprocation of said rod causes said nip rolls to move into driving engagement with one or the other of said speed-control rolls.

5. A variable rate strand feeding device wherein a plurality of separate strands are fed to a work station comprising a pair of spaced speed-control rolls, one of said rolls adapted to rotate at a relatively slow surface speed and the other of said rolls adapted to rotate at a relatively high surface speed, a plurality of separate rotatable drive means, each said drive means adapted to continuously frictionally engage a separate strand, said drive means positioned side by side between said speed-control rolls and adapted to be independently selectively engaged with the surface of either of said speed-control rolls so as to rotate said drive means to simultaneously feed strand at either a relatively low rate or a relatively high rate, depending upon which speed-control roll each drive means is in engagement.

6. The device of claim 5, each of said drive means comprising a pair of nip rolls supported for opposed contacting rotation with each other from one end of a lever in turn supported for pivotal movement about an intermediate fulcrum, and actuation means engaged with the other ends of said levers for independently moving each such lever so as to alternatively engage one of said nip rolls supported thereby with the surface of one of said speed-control rolls.

7. The device of claim 6, said speed-control rolls and said drive means being mounted so that the individual nip rolls of opposed pairs thereof are each proximate to a different speed-control roll.

8. The device of claim 7, each of said levers having individual strand guide means attached thereto for guiding the strand into the nip of said rolls.

9. The device of claim 6, said levers having a common fulcrum comprising a pin for supporting said levers through aligned openings formed therein, said pin further supporting spacers interposed between said levers for spacing each of said levers and pairs of said nip rolls from each other.

10. The device of claim 9, said levers and said drive means simultaneously removable as a unit from operative positioning with respect to said speed-control rolls.

11. The device of claim 10, each of said other ends of said levers having an open slot therein for receipt of said actuation means.

12. The device of claim 11, said actuation means including a plurality of separately reciprocal rods each having a terminal clevis and clevis pin at one end and connected to rod drive means at the other end thereof, said other ends of said levers received in said clevises and said clevis pins received in said slots.

13. The device of claim 12, said rod drive means mounted on a pivotable bracket whereby arcuate movement thereof simultaneously disengages said clevises and said clevis pins from said levers to facilitate disassembly of said levers from said device.

14. The device of claim 13, said rod drive means comprising a plurality of air-operated cylinders wherein said rods are the piston rods thereof.

15. The device of claim 14, said bracket having an L-shaped extension and means for mounting said air cylinders thereto.

16. The device of claim 9, said fulcrum pin being adjustably mounted, whereby the position of said levers with respect to said speed-control rolls may be readily adjusted.

17. The device of claim 6 further comprising program means for controlling said actuation means.

18. The device of claim 17, said program means comprising a continuously moving opaque tape having a plurality of series of openings extending thereacross, and photocell means associated with said tape, whereby the presence or absence of openings in each series causes actuation of said actuating means to independently move each lever into engagement with one or the other of said speed-control rolls.

* * * * *

UNITED STATES PATENT OFFICE

CERTIFICATE OF CORRECTION

Patent No. 4,014,489 Dated March 29, 1977

Inventor(s) Stephen M. Bialek

It is certified that error appears in the above-identified patent and that said Letters Patent are hereby corrected as shown below:

In Claim 1, Col. 7, Line 52, delete "art" and insert --at--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*